US005287811A

United States Patent [19]

Matsuura et al.

[11] Patent Number: 5,287,811

[45] Date of Patent: Feb. 22, 1994

[54] FLEXIBLE BRANCHING APPARATUS IN SUPERCONDUCTING MAGNETICALLY LEVITATED RAILWAY HAVING VARIABLE CROSS-SECTION MAIN FLEXIBLE BEAM

[75] Inventors: Akio Matsuura, Hachiouji; Atsushi Ichikawa; Genpachi Anami, both of Kokubunji; Ichirou Sugimoto, Koganei, all of Japan

[73] Assignee: Railway Technical Research Institute, Japan

[21] Appl. No.: 29,161

[22] Filed: Mar. 10, 1993

[30] Foreign Application Priority Data

Apr. 2, 1992 [JP] Japan ..... 4-080133

[51] Int. Cl.[5] ..... E01B 26/00

[52] U.S. Cl. ..... 104/130; 104/130.1; 246/434

[58] Field of Search ..... 104/48, 130, 130.1; 246/430, 434

[56] References Cited

U.S. PATENT DOCUMENTS

| | | | |
|---|---|---|---|
| 2,997,004 | 8/1961 | Rosenbaum et al. | 104/130 |
| 3,093,090 | 6/1963 | Rosenbaum | 104/130 |
| 3,635,166 | 1/1972 | Peterson | 104/130 |
| 3,661,091 | 5/1972 | Noble | 104/130 |
| 3,782,291 | 1/1974 | Maison | 104/130 |
| 3,791,306 | 2/1974 | Wagner | 104/130 |
| 3,808,977 | 5/1974 | Smoot | 104/130 |
| 3,880,085 | 4/1975 | Jacobs | 104/88 |
| 4,094,252 | 6/1978 | Pater | 104/130 |
| 4,690,064 | 9/1987 | Owen | 104/119 |
| 5,199,674 | 4/1993 | Mihirogi | 104/130.1 X |

FOREIGN PATENT DOCUMENTS

| | | | |
|---|---|---|---|
| 2542805 | 4/1977 | Fed. Rep. of Germany | 104/130 |
| 2544665 | 4/1977 | Fed. Rep. of Germany | 104/130.1 |
| 166402 | 7/1991 | Japan | 104/130 |

*Primary Examiner*—Robert J. Oberleitner
*Assistant Examiner*—S. Joseph Morano
*Attorney, Agent, or Firm*—Lorusso & Loud

[57] ABSTRACT

A flexible branching apparatus in a superconducting magnetically levitated railway having a U-shaped guideway includes a flexible main beam, which is integrally disposed along the guideway at the center thereof and has cross-sectional rigidity that gradually decreases from a fixed end to a distal end thereof, the main beam consisting of paramagnetic steel; cross beams integrated with the main beam and consisting of paramagnetic steel; runway concrete panels laid between the cross beams and supported so as not to possess transverse rigidity; short-span concrete panels connected to vertical portions of the cross beams by hinge support means, the short-span concrete panels having ground coils mounted thereon and constructing side walls for guidance; a driving device for driving the distal end of the main beam so as to be capable of forming the main beam into an alignment that does not fall below a minimum radius of curvature decided from an acceleration level for riding comfort; and a stopping device and locking device for restraining movement of the main beam upon completion of movement of the distal end thereof. Despite the fact that the guideway is U-shaped, bending into a planned alignment can be performed merely by driving a single location, namely the distal end portion.

13 Claims, 6 Drawing Sheets

FLEXIBLE BRANCHING APPARATUS IN SUPERCONDUCTING MAGNETICALLY LEVITATED RAILWAY HAVING VARIABLE CROSS-SECTION MAIN FLEXIBLE BEAM

BACKGROUND OF THE INVENTION

This invention relates to a flexible branching apparatus (turnout switch) in a superconducting magnetically levitated railway and, more particularly, to a flexible branching apparatus for use in a U-shaped guideway, wherein the branching apparatus exploits the excellent flexing property of steel, has a small number of driving devices and a small magnetic drag.

Examples of devices in this technical field are disclosed in the specifications of Japanese Patent Application Laid-Open No. 1-269668 and Japanese Patent Publication No. 61-53448. These disclosures relate to a branching apparatus of traverse type, namely a branching apparatus in which a plurality of switching beams are connected so as to be capable of turning, a truck supporting each switching beam is moved so as to travel in the switching direction and the truck is halted at a stopping position by a buffer device and by means of braking, after which the truck is positioned by a locking device to thereby carry out switching.

In this prior-art branching apparatus for a superconducting magnetically levitated railway, however, the fact that a plurality of switching beams are provided necessitates the installation of a large number of driving devices. In addition, operating these driving devices synchronously is very complicated and the cost of maintenance is high. Another disadvantage of the prior art is that the apparatus employs a concrete structure of great weight.

Accordingly, a flexible branching apparatus that makes use of the excellent flexing property of steel has been considered. Working examples of a flexible branching apparatus have been realized in Transrapid in Germany and Tokyo Monorail systems in Japan. Since a flexible branching apparatus of this kind is such that the cross section of the branching beams is I-shaped or box-shaped, it is comparatively easy to bend the beams. However, since the guideway of a superconducting magnetically levitated railway has a U-shaped structure, it is necessary to effect flexing in such a manner that the cross section of the guideway is not deformed. Furthermore, in a case where the apparatus is made of steel, the following problems must be solved:

(1) In case of a steel beam, an expedient that reduces magnetic drag is required.

(2) Since loading under passing vehicles and flexing of the branching apparatus occur repeatedly, it is necessary to prevent the occurrence of fatigue failure.

SUMMARY OF THE INVENTION

An object of the present invention is to provide a flexible branching apparatus (turnout switch) in a superconducting magnetically levitated railway, wherein the apparatus finds use in a U-shaped guideway, exploits the excellent flexing property of steel, has a small number of driving devices, is light in weight, is capable of shortening switching time and exhibits a small magnetic drag.

According to the present invention, the foregoing object is attained by providing a superconducting magnetically levitated railway having a U-shaped guideway, comprising a centrally and integrally disposed flexible main beam having cross-sectional rigidity that gradually decreases from a fixed end to a distal end thereof and consisting of paramagnetic steel, cross beams integrated with the main beam and consisting of paramagnetic steel, runway concrete panels laid between the cross beams and supported so as not to possess transverse rigidity, short-span concrete panels connected to vertical portions of the cross beams by hinge support means, the short-span concrete panels having ground coils mounted thereon and forming side walls of a trackway, a driving device for driving the distal end of the main beam so as to be capable of forming the main beam into an alignment that does not fall below a minimum radius of curvature decided from an acceleration level for riding comfort, and a stopping device and locking device for restraining movement of the main beam upon completion of movement of the distal end thereof.

Further, the cross beams include a fixed support-point cross beam, intermediate support-point cross beams disposed at prescribed intervals, a distal-end support-point cross beam and intermediate cross beams disposed between these cross beams.

Furthermore, the intermediate support-point beams and distal-end support-point beam are equipped with trucks having a connecting portion between a support structure and the flexible main beam that does not obstruct turning motion of the support-point beams when switching is performed.

Owing to the above-described arrangement in accordance with the present invention, even though the guideway is U-shaped, bending to a planned alignment can be achieved merely by applying a driving force at a single point, namely the distal end of the main beam. In addition, the cross-sectional shape is decided taking into consideration the width and/or thickness of the main beam in such a manner that a localized concentration of stress will not occur. This makes it possible to minimize the effects of metal fatigue.

The main beam and cross beams are made of a paramagnetic steel and they are spaced away from the superconducting magnet. As a result, there is little magnetic drag.

Furthermore, the arrangement is such that rigidity of the support-point cross beams is increased with respect to transverse loads, and no problems arise in terms of overall torsion.

In addition, the switching time of the branching apparatus can be shortened. More specifically, whereas switching time is 30 seconds in the prior art, it can be shortened to 15 seconds according to the present invention.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the present invention will now be described in detail with reference to FIGS. 1 through 7. It should be noted that a car body 11 also is illustrated in the sectional views of FIGS. 3 through 6.

In a flexible branching apparatus of a superconducting magnetically levitated railway having a U-shaped guideway, as illustrated in these drawings, a flexible main beam 1 is integrally disposed at the center of the guideway and has cross-sectional rigidity that gradually decreases from a fixed end to a distal end thereof. The main beam consists of paramagnetic steel.

Figure 1:
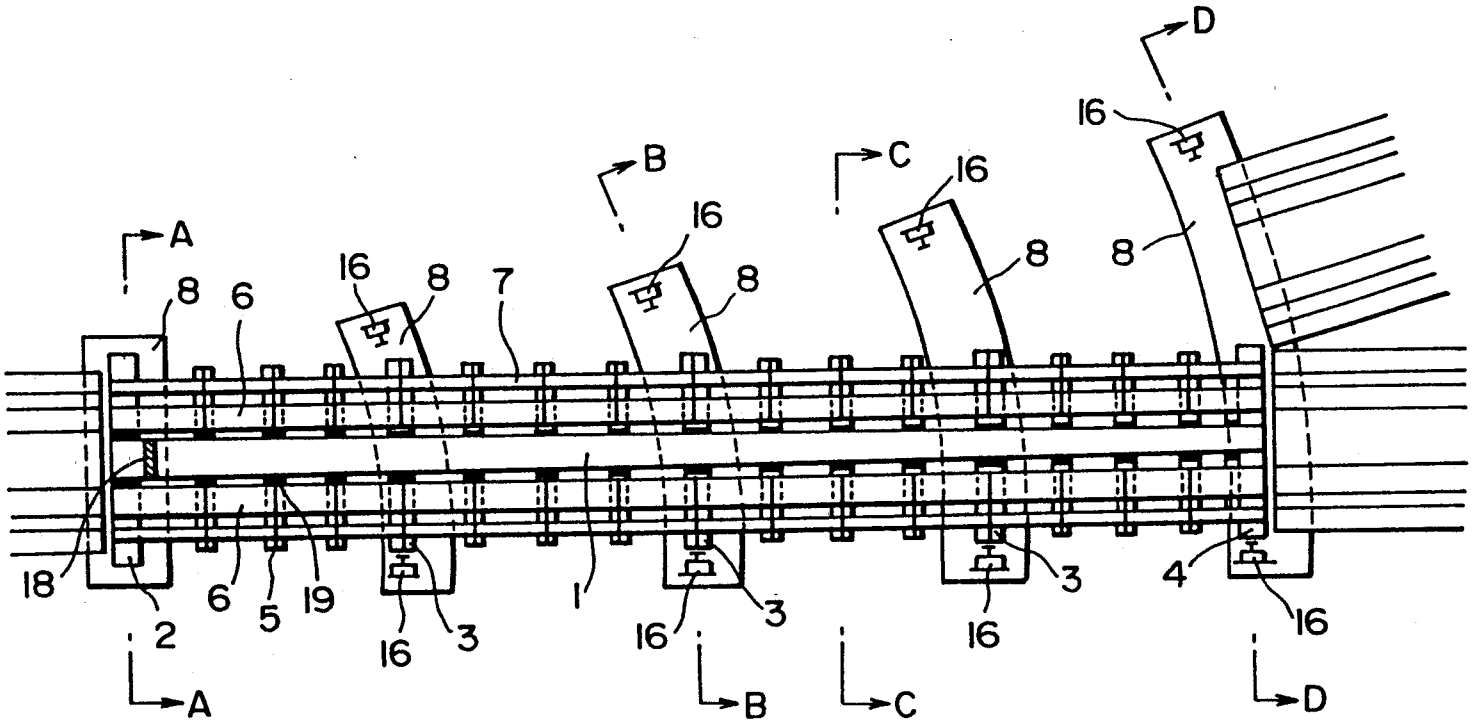
FIG. 1 is a plan view of a rightward switched flexible branching apparatus in a superconducting magnetically levitated railway embodying the present invention.

In order to reduce the cross-sectional rigidity of the flexible main beam 1 gradually from the fixed end to the distal end thereof, the flexible main beam 1 is made from a rectangular pipe, by way of example, and, on the assumption that the main beam 1 has a width $W_1$ (see FIG. 3) at a sectional portion (fixed portion) along line A—A in FIG. 1; a width $W_2$ (see FIG. 4) at a sectional portion (intermediate support-point cross beam) along line B—B in FIG. 1; a width $W_3$ (see FIG. 5) at a sectional portion (intermediate cross beam) along line C—C in FIG. 1; and a width $W_4$ at a sectional portion (distal-end support-point cross beam) along line D—D in FIG. 1, the main beam 1 is constructed in such a manner that these widths gradually decrease from the fixed end to the distal end of the beam. In other words, these widths are related as $W_1>W_2>W_3>W_4$.

It is also possible to adopt a construction in which the width is kept fixed while the thickness of the flexible main beam comprising a rectangular pipe is gradually reduced from the fixed end to the distal end. More specifically, though the particulars are not shown, let $T_1$ represent the thickness of the flexible main beam at the sectional portion (fixed portion) along line A—A in FIG. 1; $T_2$ the thickness at the sectional portion (intermediate support-point cross beam) along line B—B in FIG. 1; $T_3$ the thickness at the sectional portion (intermediate cross beam) along line C—C in FIG. 1; $T_4$ the thickness at the sectional portion (distal-end support-point cross beam) along line D—D in FIG. 1. In this case, the main beam 1 would be constructed in such a manner that these thicknesses gradually decrease from the fixed end to the distal end of the beam. In other words, these thicknesses are related as $T_1>T_2>T_3>T_4$.

Furthermore, an arrangement can be adopted in which both the width and the thickness of the flexible main beam are gradually reduced from the fixed end to the distal end. That is, it can be arranged so that the widths of the flexible main beam are related as $W_1>W_2>W_3>W_4$ while the thicknesses thereof are related as $T_1>T_2>T_3>T_4$.

By virtue of this arrangement, the flexible main beam 1 is endowed with flexibility so that it will bend just as a stalk of bamboo growing out of the ground.

More specifically, the flexible main beam 1 is so constructed, taking into account both its width and thickness, that the cross-sectional rigidity thereof decreases from the fixed end to the distal end in such a manner that an appropriate radius of curvature is obtained while the main beam is provided with resistance to stress.

Cross beams comprising paramagnetic steel are integrated with the flexible main beam 1. In this case, isolating joints 19 are provided between the flexible main beam 1 and the cross beams.

The cross beams include a fixed support-point cross beam 2, intermediate support-point cross beams 3 and a distal-end support-point cross beam 4, which are disposed at prescribed intervals, as well as intermediate cross beams 5 disposed between these cross beams. These cross beams have a structure that does not contribute to rigidity in the flexing direction of the flexible main beam 1, and they consist of paramagnetic steel.

Runway concrete panels 6 are laid between the cross beams and are supported so as not to contribute rigidity in the bending direction of the flexible main beam 1. For example, the runway concrete panels 6 are supported at four points. One of these four points is fixed so that only rotation will not be restrained. The other three points are supported resiliently on the cross beams so as to allow these concrete panels to undergo relative movement in conformity with the bending of the flexible main beam 1.

Short-span concrete panels 7 have ground coils and are supported at four points on vertical portions 2*a*, 3*a*, 4*a*, 5*a* of the respective cross beams. One of these four points is fixed so that only rotation will not be restrained. The other three points are supported resiliently so as to allow these concrete panels to undergo relative movement in conformity with the bending of the flexible main beam 1.

It should be noted that an arrangement can be adopted in which the runway concrete panels 6 have the ground coils while ground coils are not mounted on the short-span concrete panels 7, which construct the side walls of the trackway. In such case, the short-span concrete panels 7 would serve only as a surface on which guiding wheels of a vehicle would run. In addition, a structure can be adopted in which levitating coils are provided on the runway concrete panels 6 and propulsion and guidance coils are provided on the short-span concrete panels 7.

A supporting truck 17 provided on each of the intermediate support-point cross beams 3 and a driving truck 10 provided on the distal-end support-point cross beam 4 each have a cylindrical steel bar provided on the central portion thereof. Each steel bar is fitted into a corresponding oblong hole, which is provided in the bottom of the flexible main beam 1 and elongated in the traveling direction of the vehicle, thereby connecting the trucks to the flexible main beam 1. As a result, a connecting portion is provided that does not obstruct the flexible main beam 1 from moving relative to the cross beams in the vehicle traveling direction (i.e., that does not obstruct elongation of the main beam or the locus thereof at the time of a rise in temperature) and that does not obstruct turning motion of the flexible main beam 1 relative to the trucks, which undergo rectilinear motion. Furthermore, the force in the vehicle traveling direction (propulsive force or braking load, etc.) occurs at the fixed portion. Each truck has, in addition to the connecting portion, a supporting structure for supporting the weight of the main beam smoothly and providing smoothness at the surface of contact with the cross beams so that rotational motion of the support-point cross beams is not impeded at the time of switching.

Thus, the portions projecting from the flexible main beam 1 do not contribute to rigidity in the bending direction of the flexible main beam, as a result of which the flexible main beam 1 is allowed to bend.

In addition, rigidity of the support-point cross beams is increased with respect to transverse loads so that strength against overall torsion is increased.

The various components will now be described in greater detail.

Figure 3:
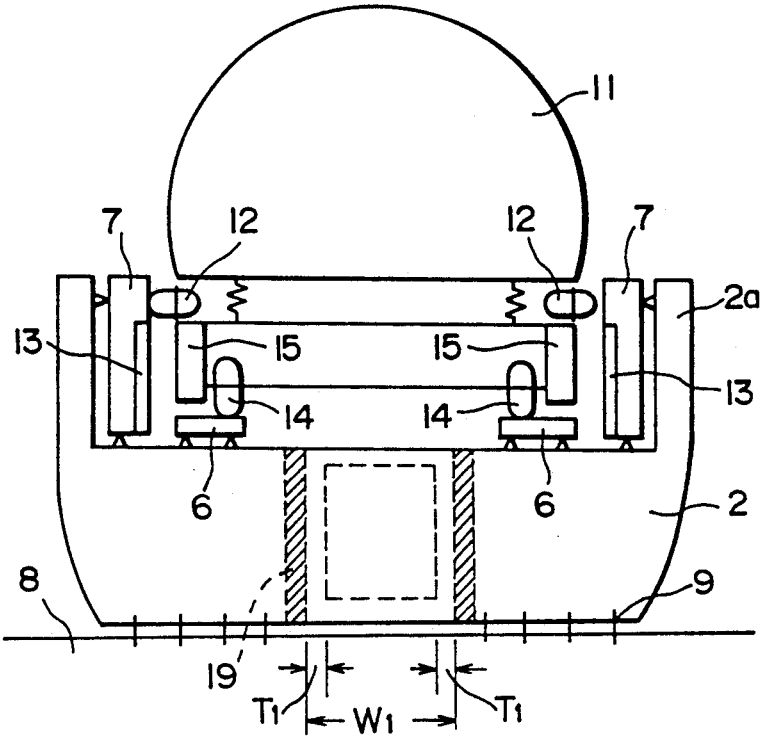
FIG. 3 is a sectional view taken along line A—A (a fixed support-point cross beam) of FIG. 1.

As shown in FIG. 3, a bending moment produced by a driving force that acts at the distal-end support-point cross beam 4 (see FIG. 1) is transmitted to a support-point foundation 8 by a fixing device 9 in the fixed support-point cross beam 2. Though the fixing device 9 usually consists of anchor bolts, it is permissible to secure the fixed support-point cross beam 2 to the support-point foundation 8 directly by concrete. The fixed support-point cross beam may be mounted on the foundation 8 for rotation through an angle that does not exceed a maximum breaking angle decided in accordance with an acceleration level for riding comfort.

The short-span concrete panels 7, which form the trackway side walls and have ground coils 13, are placed on the vertical portions 2*a* of the fixed support-point cross beam 2.

In a case where a car body 11 runs on wheels 14 (these wheels, for which rubber tires usually are employed, support the car body 11 when the vehicle is traveling and when it is at rest), the runway concrete panels 6 bear the weight of the car body 11. When the vehicle is traveling while levitated, the runway concrete panels 6 fill up gaps and serve to prevent noise in cooperation with other materials. The ground coils 13 comprise coils that levitate, guide and propel the car body 11. Superconducting magnets 15 mounted on the vehicle are provided so as to oppose the ground coils 13. An auxiliary guiding device 12 transmits the transverse load of the vehicle to the short-span concrete panels 7. In other words, the short-span concrete panels 7 bear the transverse load of the vehicle via the auxiliary guiding device 12 at the time of an abnormality such as quenching or when the vehicle is traveling.

Though the details will be described later, the driving force that acts upon the distal-end support-point cross beam 4 gives rise to a maximum bending moment at the fixed support-point cross beam 2. Though the bending moment of the flexible main beam 1 may be dealt with by increasing the cross section of the main beam, welds at portions where the cross beams are attached tend to develop cracks due to metal fatigue. These portions are provided with splicing plates 18 and the portions at which the cross beams are attached are replaced periodically. In other words, by adopting a structure that makes local replacement feasible, it is possible to deal with weld cracks caused by metal fatigue.

Figure 4:
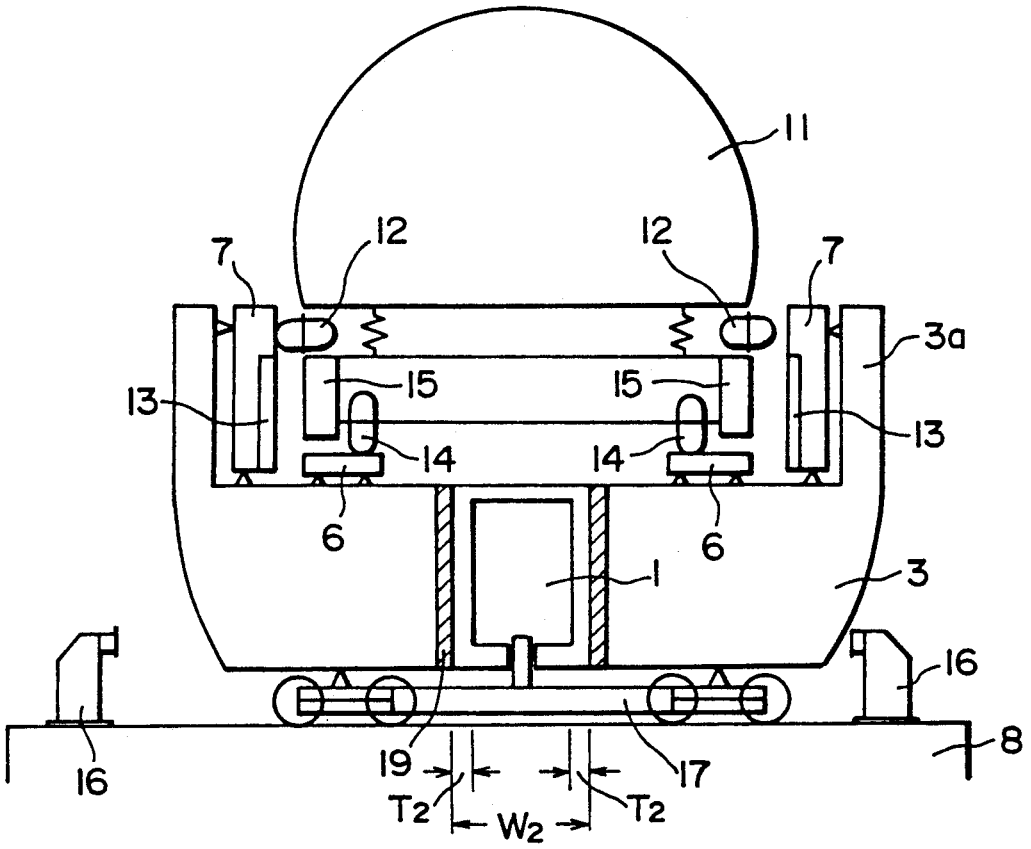
FIG. 4 is a sectional view taken along line B—B (an intermediate support-point cross beam) of FIG. 1.

As shown in FIG. 4, the supporting truck 17, which is not equipped with a driving device, is provided on the support-point foundation 8 serving as the foundation of the intermediate support-point cross beam 3. The foundation 8 usually is a bridge pier made of concrete. The supporting truck 17 supports the flexible main beam 1 and, when the flexible main beam 1 moves, so does the support truck 17 so as not to impede this motion. Both sides of the support-point foundation 8 are provided with a stopping device 16 and locking device (not shown) for limiting excess movement of the flexible main beam 1. Further, the runway concrete panels 6 are arranged on the intermediate support-point cross beams 3 and the short-span concrete panels 7 are arranged on the vertical portions 3*a* of the intermediate support-point cross beams 3.

Figure 5:
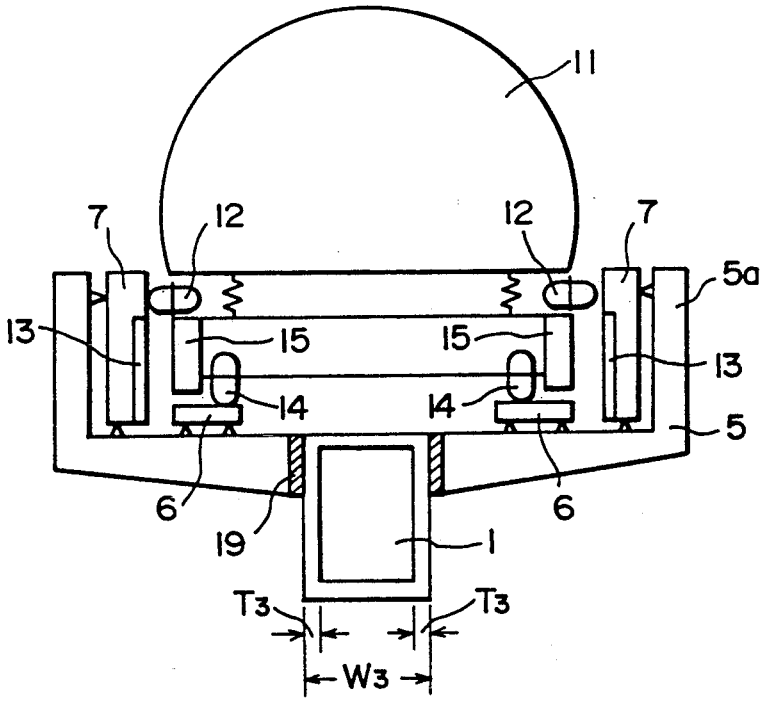
FIG. 5 is a sectional view taken along line C—C (an intermediate cross beam) of FIG. 1.

As shown in FIG. 5, each intermediate cross beam 5 is a beam supporting the runway concrete panels 6 and the short-span concrete panels 7. Though the projecting girder portion is made of steel, the vertical portion 5*a* of the intermediate beam 5 can have a structure made of steel-reinforced concrete if the magnetic drag is too large.

Figure 6:
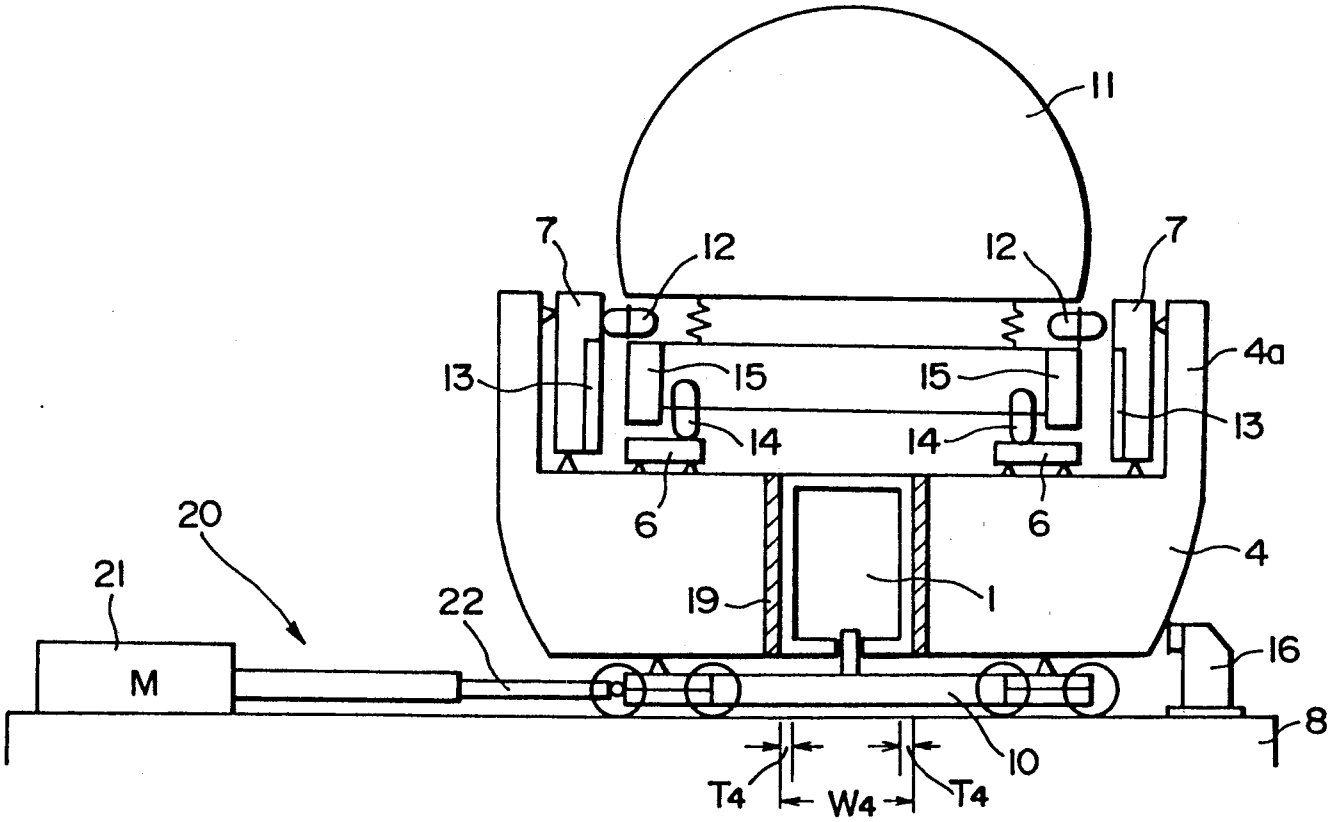
FIG. 6 is a sectional view taken along line D—D (a distal-end support-point cross beam) of FIG. 1.
Figure 7:
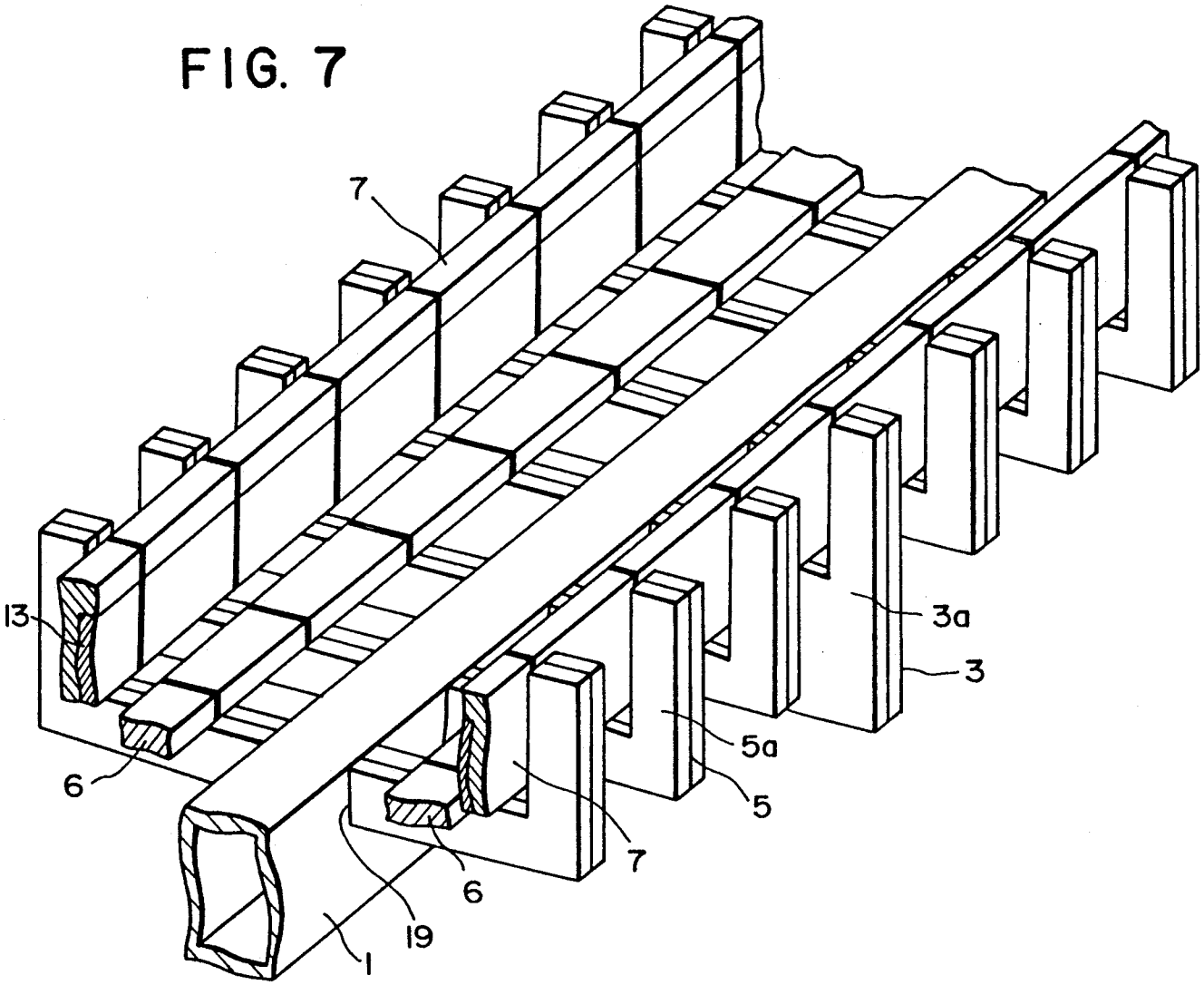
FIG. 7 is a perspective view illustrating the vicinity of intermediate cross beams.

As illustrated in FIG. 6, the distal-end support-point cross beam 4 is provided with a driving device 20 having a motive means 21, e.g. a stationary mounted motor, and a drive mechanism 22 driven by the driving device 20 so as to undergo linear reciprocating motion. The distal-end support-point cross beam 4 on the support-point foundation 8 is driven by the driving device 20. More specifically, the driving truck 10 is provided below the distal-end support-point cross beam 4 and is pushed or pulled in a direction that intersects the track, whereby the flexible main beam 1 is capable of being bended so as to attain an alignment that does not fall below a minimum radius of curvature decided from an acceleration level for riding comfort. Numeral 4*a* denotes the vertical portion of the distal-end support-point cross beam 4.

Figure 2:
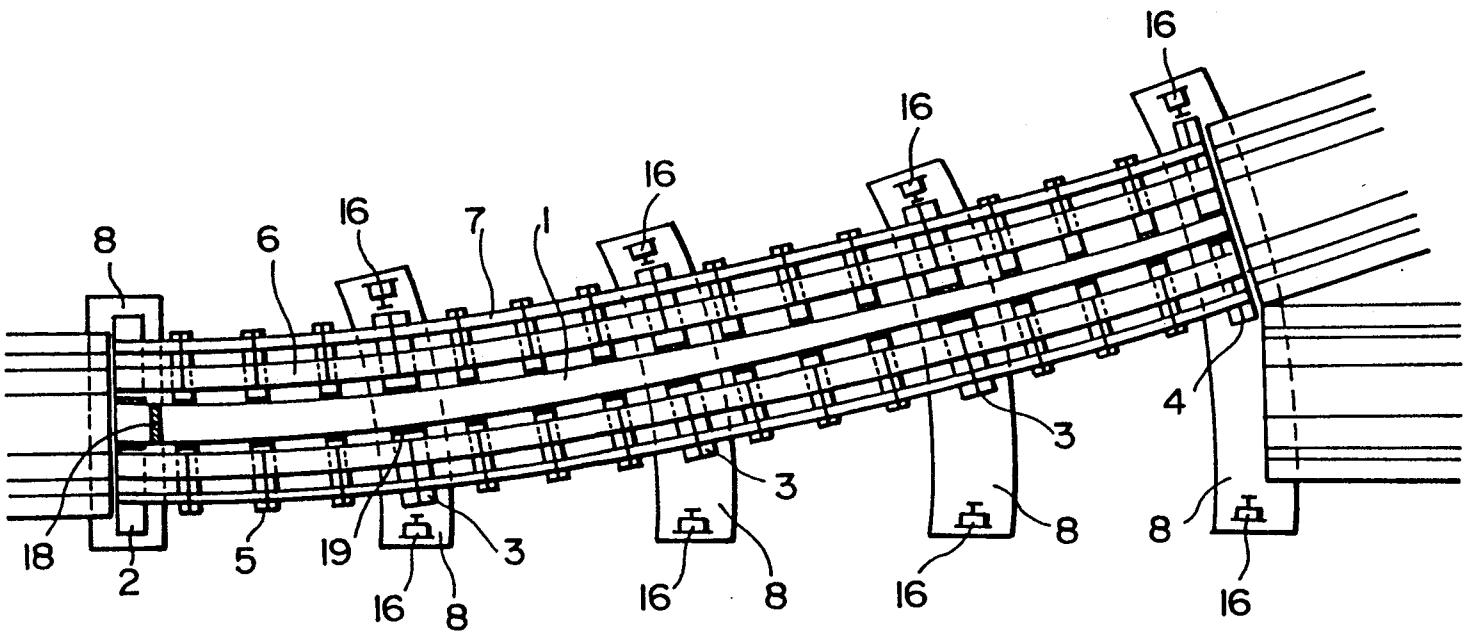
FIG. 2 is a plan view of a leftward switched flexible branching apparatus in a superconducting magnetically levitated railway embodying the present invention.

In a case where the distal-end support-point cross beam 4 is in a state in which it is situated at the stopping device 16 on the right end, as shown in FIG. 6, namely in a case where the distal-end support-point cross beam 4 is as depicted in FIG. 1, the flexible branching apparatus of the superconducting magnetically levitated railway provides a route to the right. When the distal-end support-point cross beam 4 is pulled by driving the driving device 20 so that the cross beam 4 moves against the stopping device 16 on the left end, the flexible branching apparatus of the superconducting magnetically levitated railway provides a route to the left as illustrated in FIG. 2.

Though not shown, the locking devices are deployed at the positions of the stopping devices 16 and are adapted so as to maintain the state to which the changeover has been made. As an example of the locking device, a switch is actuated when the truck arrives at the switchover position and contacts a stopper, thereby actuating an electromagnetic device to lock the truck against motion. Movement of the cross beam can be confirmed by suitably disposing an appropriate sensor.

Furthermore, motive means 21 for the driving truck 10 may be a hydraulic jack instead of a motor. In another arrangement, the motor may be mounted on the driving truck 10 so that the driving truck 10 can be made self-propelled.

As described above, the longitudinally extending flexible main beam 1 made of paramagnetic steel is disposed at the center of the U-shaped guideway. By varying the cross-sectional rigidity of the flexible main beam 1, the main beam 1 can be bent to a planned alignment merely by moving it at one location, namely the distal end.

Since the cross-sectional shape is decided in such a manner that a local concentration of stress and fatigue failure will not occur. Moreover, the arrangement is such that rigidity of the support-point cross beams is increased with respect to transverse loads so that no problems arise in terms of overall torsion.

Furthermore, the flexible main beam 1 is made of a paramagnetic steel and it is spaced away from the superconducting magnets. As a result, there is little magnetic drag.

(A) In order that the magnetic drag may be reduced to a prescribed level, the fluctuating magnetic field is analyzed and the following measures are taken:

(1) All of the structural members are made of steel exhibiting little magnetism.

(2) The flexible main beam, which develops the largest magnetic drag, is disposed at a central position of the beams farthest from both superconducting magnets of the vehicle.

(3) The steel material of the cross beams at the projecting portions nearest the superconducting magnets is segmented as much as possible to reduce excessive magnetically induced eddy current.

(4) An isolating joint is provided between the main beam and the cross beams so as to prevent magnetically induced eddy currents from flowing between them.

(5) A steel-reinforce concrete structure is employed at the vertical portions of the cross beams nearest the superconducting magnets. As a result, structural strength can be assured even if the steel material is segmented in order to reduce magnetic drag.

(B) In order to increase rail capacity, switching time of the branching apparatus, which is one impedement to higher rail capacity, is shortened in the following manner:

(1) The conventional concrete structure is changed to a steel structure to lighten the branching apparatus.

(2) Cross-sectional rigidity of the flexible main beam is changed in a planned manner and the flexible main beam is made to assume a prescribed alignment merely by applying a driving force at one point, namely the distal end of the main beam.

(3) The driven portion is located at a single point, namely the distal end of the main beam, and it is arranged so that mere passive stopping devices serve as the other support portions of the main beam. This simplifies the drive system, the position sensing system and the signal system.

(C) In order to obtain a branching apparatus that is free of troubles, the reliability of the apparatus is improved upon taking the following points into consideration:

(1) The number of component parts is reduced by simplifying the driving devices and the signal system.

(2) The overall branching apparatus is made light in weight, thereby reducing the load on the driving devices.

(D) In order to improve resistance to fatigue, which is a problem in terms of the durability of the apparatus, the following arrangement is adopted:

(1) The cross-sectional rigidity of the flexible main beam is changed in a planned manner so that a local concentration of stress will not occur.

(2) Splicing plates are provided between the flexible main beam which, in actual results so far, presents a problem in terms of fatigue, and the fixed support-point cross beams, and a structure is adopted in which only this portion is replaceable.

By virtue of the arrangement described above, strength and alignment of the branching apparatus at flexure and the strength of the apparatus with respect to transverse load at high-speed travel (linear) can be satisfactorily attained.

With regard to magnetic drag, this can be reduced to less than 5.0 kN/truck, which is the same as in the prior art, even though the conventional concrete structure is changed to a steel structure.

It should be noted that the present invention is not limited to the foregoing embodiment but can be modified in various ways without departing from the scope of the claims.

Thus, in accordance with the present invention, as described in detail above, there is provided a flexible branching apparatus of a superconducting magnetically levitated railway, wherein the apparatus finds use in a U-shaped guideway, exploits the excellent flexing property of steel, has a small number of driving devices, is light in weight and is capable of shortening switching time and exhibits a small magnetic drag.

What we claim is:

1. A switching apparatus for switching between ranches in a U-shaped guideway for a superconducting magnetically levitated railway, comprising:

(a) a flexible main beam, which is integrally disposed along said guideway at the center thereof and has cross-sectional rigidity that gradually decreases from a fixed end to a distal end thereof, said main beam consisting of paramagnetic steel;

(b) cross beams integrated with said main beam and consisting of steel exhibiting a comparatively low magnetism;

(c) runway panels laid between said cross beams and supported so as not to possess transverse rigidity;

(d) short-span panels connected to vertical portions of said cross beams by hinge support means, said short-span panels having ground coils mounted thereon and forming side walls of said guideway for guidance;

(e) a driving device for moving the distal end of said main beam between at least two different positions providing two different routes in the guideway; and (f) a stopping device for limiting movement of said distal end, thereby defining one of said positions and completion of movement of said distal end.

2. The apparatus according to claim 1, wherein said flexible main beam comprises a pipe having a rectangular cross section and has a structure in which the width of said pipe gradually decreases from the fixed end to the distal end.

3. The apparatus according to claim 1, wherein said flexible main beam comprises a pipe having a rectangular cross section and has a structure in which the thickness of said pipe gradually decreases from the fixed end to the distal end.

4. The apparatus according to claim 1, wherein said cross beams include a fixed support-point cross beam, intermediate support-point cross beams disposed at prescribed intervals, a distal-end support-point cross beam and intermediate cross beams disposed between these cross beams.

5. The apparatus according to claim 4, wherein said intermediate support-point beams are each equipped with a supporting truck, and said distal-end support-point beam is equipped with a driving truck.

6. The apparatus according to claim 5, wherein the supporting trucks provided on said intermediate support-point cross beams and the driving truck provided on said distal-end support-point cross beam are equipped, at the center thereof, with a connecting portion which does not impede motion of said main beam that attempts to move in a vehicle traveling direction with respect to the trucks below said main beam, and which allows said main beam to move together with said trucks in a driven direction, and both ends of said trucks have a support structure which supports weight of the beams transmitted form the support-point cross beams, and which does not impede rotational motion of the support-point cross beams when switching is carried out.

7. The apparatus according to claim 4, wherein said fixed support-point cross beam is equipped with a support-point structure in which said support-point cross beam is not completely fixed to a support-point foundation but is allowed to rotate through an angle that does not exceed a maximum breaking angle decided in accordance with an acceleration level for riding comfort.

8. The apparatus according to claim 4, wherein a splicing plate is provided between said flexible main beam and said fixed support-point cross beam, thereby providing a structure in which only this portion is replaceable.

9. The apparatus according to claim 1, wherein said ground coils include a propulsion coil, a levitation coil and a guidance coil.

10. The apparatus according to claim 1, wherein each of said cross beams comprises a segmented member.

11. The apparatus according to claim 1, further comprising an insulating joint provided between said main beam and each of said cross beams.

12. The apparatus according to claim 1, wherein said driving device is one of a motor and a hydraulic jack.

13. The apparatus according to claim 1, wherein said stopping device is mounted in such a manner that alignment of said main beam at said one position is capable of being changed.

* * * * *

UNITED STATES PATENT AND TRADEMARK OFFICE

CERTIFICATE OF CORRECTION

PATENT NO. : 5,287,811
DATED : February 22, 1994
INVENTOR(S) : MATSUURA et al

It is certified that error appears in the above-indentified patent and that said Letters Patent is hereby corrected as shown below:

ON THE FACE OF THE PATENT:

"[75] Inventors: Akio Matsuura, Hachiouji; Atsushi Ichikawa; Genpachi Anami, both of Kokubunji; Ichirou Sugimoto, Koganei, all of Japan"

should read

--[75] Inventors: Akio Matsuura, Atsushi Ichikawa, Genpachi Anami, Ichirou Sugimoto, all of Tokyo, Japan--

Column 8, line 21, "ranches" should read --branches--.

Signed and Sealed this

Fifteenth Day of November, 1994

*Attest:*

Bruce Lehman

BRUCE LEHMAN

*Attesting Officer*

*Commissioner of Patents and Trademarks*